US006035611A

United States Patent [19]

Lerner

[11] Patent Number: 6,035,611

[45] Date of Patent: Mar. 14, 2000

[54] PROCESS FOR MAKING PACKAGING MATERIALS

[75] Inventor: Hershey Lerner, Aurora, Ohio

[73] Assignee: Automated Packaging Systems, Inc., Streetsboro, Ohio

[21] Appl. No.: 09/196,969

[22] Filed: Nov. 20, 1998

[51] Int. Cl.[7] ..... B65B 43/04

[52] U.S. Cl. ..... 53/455; 53/384.1

[58] Field of Search ..... 53/455, 459, 133.3, 53/133.6, 133.8, 468, 469, 284.7, 570, 384.1, 568, 212; 493/230, 233, 238

[56] References Cited

U.S. PATENT DOCUMENTS

| | | | |
|---|---|---|---|
| 3,283,672 | 11/1966 | Mueller | 493/212 |
| 3,791,573 | 2/1974 | Titchenal et al. | 383/37 |
| 4,655,737 | 4/1987 | Benoit | 493/232 |
| 4,665,552 | 5/1987 | Lems et al. | 53/570 |
| 4,945,714 | 8/1990 | Bodolay et al. | 53/568 |
| 5,045,040 | 9/1991 | Vetter | 493/212 |
| 5,226,858 | 7/1993 | Snowdon | 493/238 |
| 5,470,419 | 11/1995 | Sasaki et al. | 493/212 |
| 5,514,067 | 5/1996 | Schmidt et al. | 493/233 |
| 5,519,982 | 5/1996 | Herber et al. | 53/133.3 |
| 5,711,751 | 1/1998 | Harmanoglu | 493/212 |
| 5,722,218 | 3/1998 | Lerner . | |
| 5,743,070 | 4/1998 | Lerner . | |

*Primary Examiner*—Eugene L. Kim
*Attorney, Agent, or Firm*—Watts, Hoffman, Fisher & Heinke Co.

[57] ABSTRACT

A process of manufacturing webs of side connected bags is disclosed. A tube of heat sealable material is flattened and spaced, transverse seals are formed from one edge of the tube toward the other to delineate bag sides. Thereafter, the seals are bisected by lines of weakness to facilitate separation of sides of adjacent bags. Longitudinal lines of weakness are formed immediately adjacent the seals to delineate the tops of bag faces and backs and a separate top or lip section.

10 Claims, 3 Drawing Sheets

PROCESS FOR MAKING PACKAGING MATERIALS

This invention is directed to a process of making webs of interconnected bags used in packaging and more particularly to a process of making webs of bags which are opened to a rectangular configuration when passing through a loading station.

BACKGROUND OF THE INVENTION

U.S. Pat. No. 5,743,070 issued Apr. 28, 1998 to Hershey Lerner and Dana J. Liebhart (herein "the SP Patent") discloses a packaging system which is enjoying significant commercial success. With the machine of the SP Patent, webs of side connected bags are used. Each web is an elongated, flattened, plastic tube which includes a top section which itself is essentially a tube. In use the top section is fed over a mandrel and past a slitter which separates the top section into two upstanding lips. The lips are grasped by unique belts that are fed along divergent paths of travel into parallel paths through a load station. The unique belts are described more fully in U.S. Pat. No. 5,722,218 issued Mar. 3, 1998 to Hershey Lerner under the title Plastic Transport System (herein "the Belt Patent"). The disclosures of the SP Patent and the Belt Patent are incorporated by reference.

Each web includes side connected bags which depend from the lips. As a web is fed along its path of travel through a machine of the SP Patent (the SP Machine), lines of weakness interconnecting sides of adjacent bags are ruptured to leave individual webs depending from the lips.

As the belts diverge, the gripped lips are separated from the depending bags along lines of weakness to the extent necessary to cause the bags to span the space between the parallel paths in a generally rectangular opening.

A problem that has manifested itself, is that the bags have not consistently opened into rectangular configurations, but rather assume other trapezoidal shapes. Moreover, the trapezoidal shapes assumed vary from web to web and indeed on occasions from bag to bag within the same web.

While the failure to open into a truly rectangular configuration can be tolerated with some products, there are other products which make the system of the SP Machine unacceptable. For example, if one is seeking to tightly package sponges each in the shape of a rectangular solid, it may be impossible to insert the products into bags other than those opened to a rectangular configuration of the precise dimension required each to receive a sponge and then produce a tight fitting bag around it.

SUMMARY OF THE INVENTION

It has been discovered that if the bag side seals extend fully to the side edges of the bags adjacent the bag tops and immediately adjacent longitudinal lines of weakness that connect the lips to the bags, consistent rectangular bag. openings are achieved.

While one cannot be certain why bags produced with such side seals assure rectangular openings, it is believed it is because the seals assure concurrent commencement of equal and opposite separation of the lips from bag faces and backs, relative to the side seals. It appears that if the side seals do not come fully to the sides of bags adjacent the longitudinal perforations, there is a tendency for either the face or the back of a bag to commence to separate from the connected lip before the other does, producing an unequal length of separation between the lips and the face and back of a given bag.

Accordingly, the object of the invention is to provide a novel and improved process of making a web of so called side pouch bags in a chain with procedures that insure bags which will open into truly rectangular configurations when fed through the machine of the SP Patent.

IN THE DRAWINGS

DETAILED DESCRIPTION OF THE PREFERRED EMBODIMENT

Figure 1:
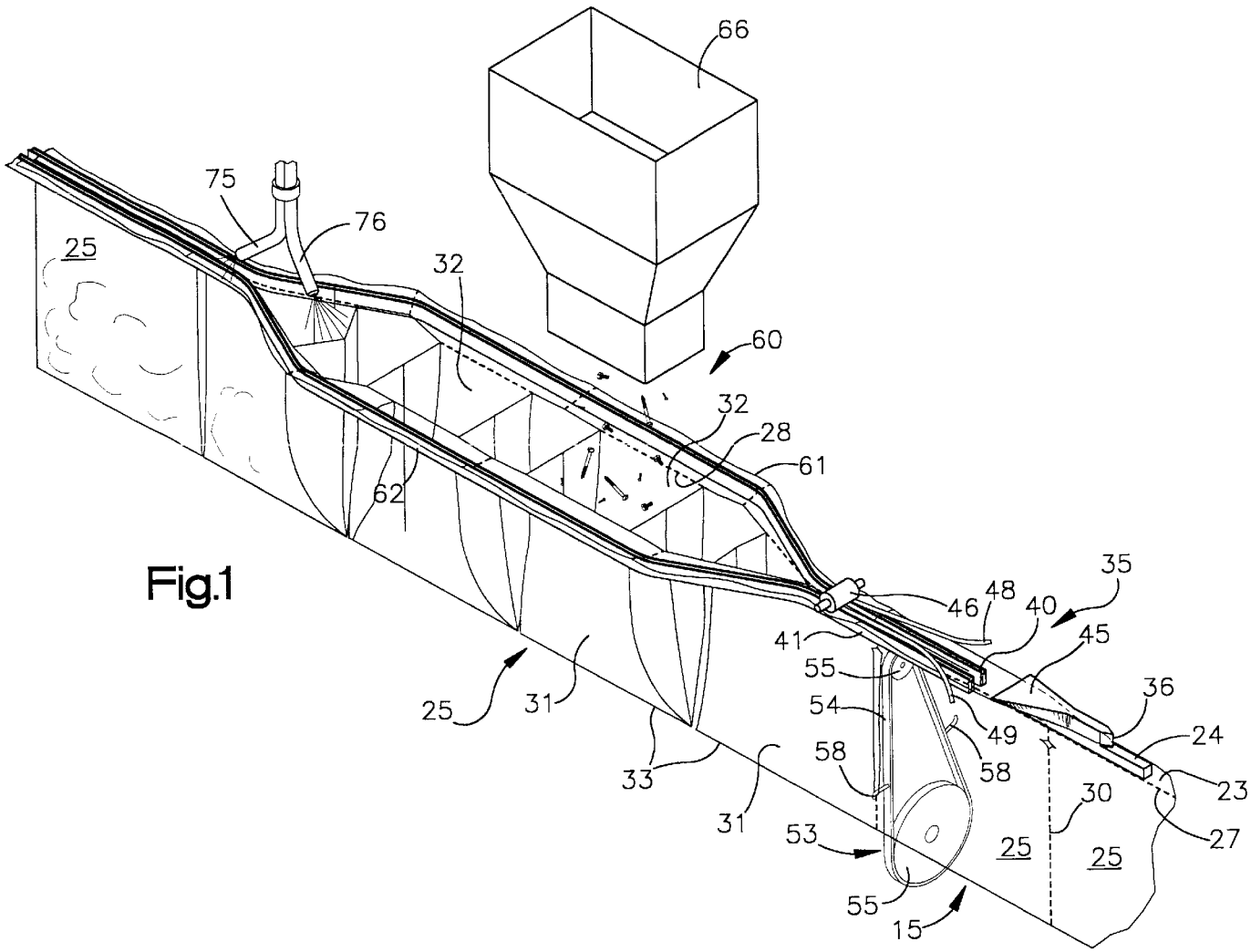
FIG. 1 is a perspective, somewhat schematic view based on FIG. 4 of the SP Patent, showing the web of this invention being fed through a load station.

Referring to the drawings, a web 15 of side connected bags is provided. The web 15 is fed from a supply (not shown) to a bagger section 17 mounted on a support carriage 20.

The web 15 is an elongated flattened plastic tube, typically formed of polyethylene. The tube includes a top or lip section 23 for feeding along a mandrel 24. The top section 23 is connected to the tops of a chain of side connected bags 25 by front and back, longitudinally extending lines of weakness in the form of perforations 27, 28. Frangible connections 30 connect, adjacent bag side edges. Each bag 25 includes a face 31 and a back 32 interconnected at a bottom 33 by a selected one of a fold or a seal. Side seals 34 adjacent the interconnections 30 delineate the sides of the bags 25. The bag faces and backs 31, 32 are respectively connected to the top section 23 by the lines of weakness 27, 28, such that the top section 23 itself is essentially a tube.

The web 15 is fed into a bag feed and preparation portion 35 of the bagger section 17. The feed is over the mandrel 24 and past a slitter 36, FIG. 1. The slitter 36 separates the lip section 23 into opposed face and back lips. The feed through the bag feed and preparation portion 35 is caused by a pair of endless, oppositely rotating, main transport belts 40, 41 supported by oppositely rotating pulley sets.

Figure 2:
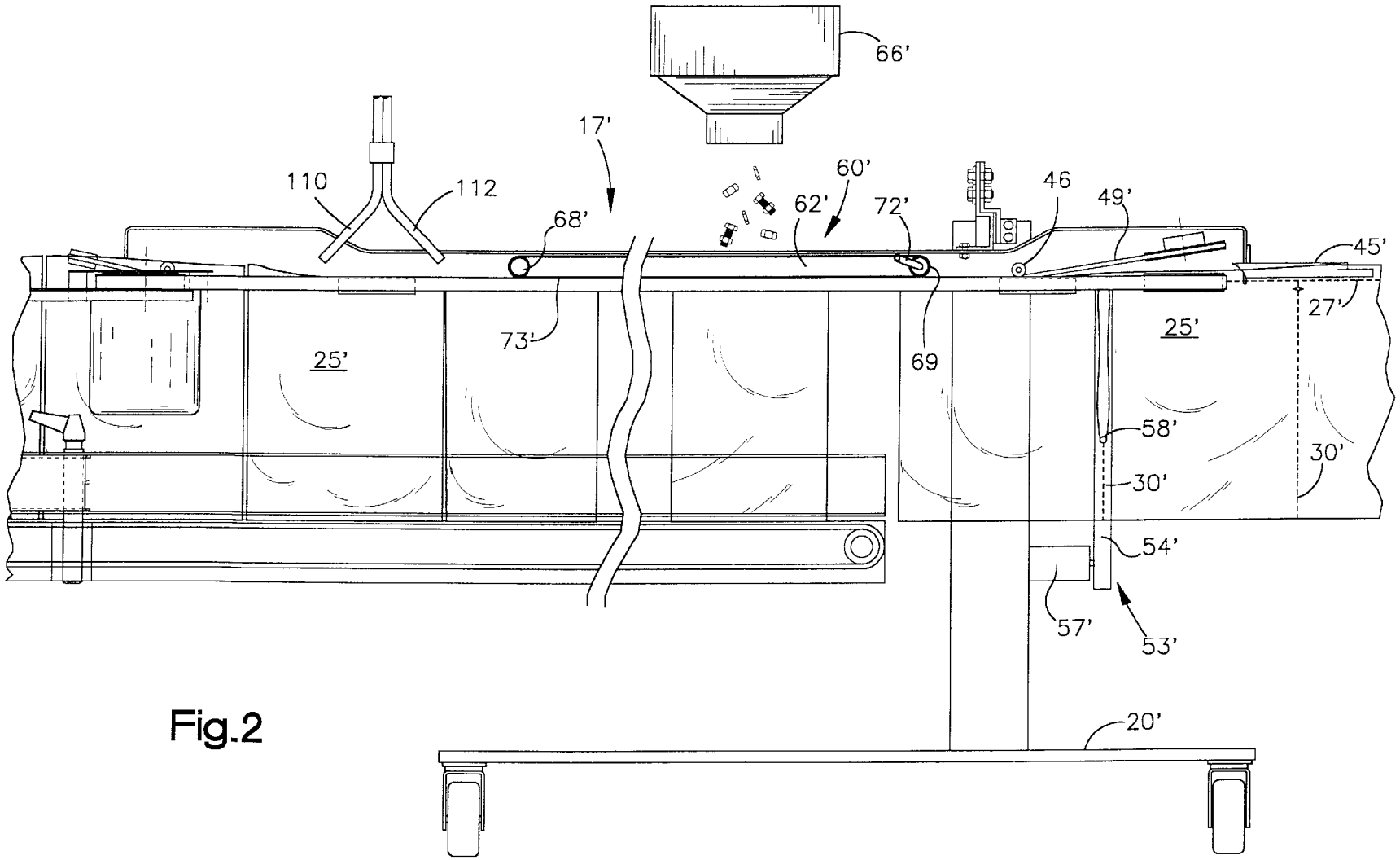
FIG. 2 is an elevational view of the load section of the SP Machine showing the web of the present invention.
Figure 3:
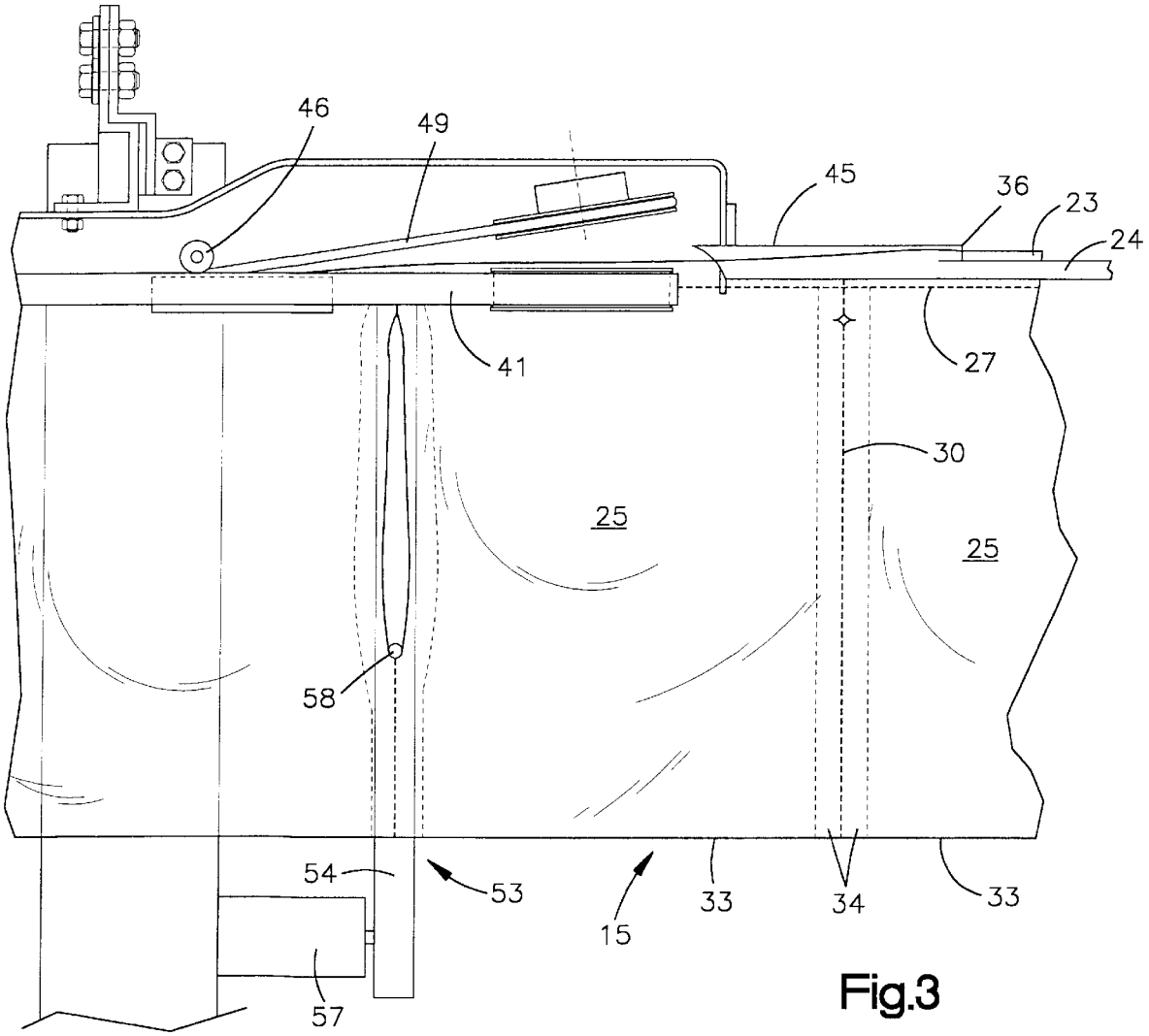
FIG. 3 is an enlarged fragmentary elevational view of a bag feed and preparation portion of the SP Machine and the web; and, FIG. 4 is a process flow chart.

A plow 45 is provided and shown in FIGS. 1, 2 and 3. The plow is positioned a short distance upstream from a roller cam 46. As the lips are drawn along by the main transport belts 41, 42, the lips are respectively folded over the main transport belts under the action of the plow 45.

Once the lips are folded over the tops of the main transport belts 41, 42, the roller cam 46 presses endless, lip transport and clamp belts 48, 49 into complemental grooves in the main transport belts 41, 42 respectively. Thus, the grooves function as bag clamping surfaces that are complemental with the clamping belts 48, 49 as is described more fully in the Belt Patent.

A bag side separator mechanism 53 is provided at a bag connection breaking station. The separation mechanism shown is not currently produced for machines of the SP Patent. Since it is an operative mechanism and the machine is disclosed only for environment and to explain the problem overcome by the present invention, we have not updated that aspect of the present disclosure. The separator mechanism 53 includes an endless belt 54 which is trained around a pair of spaced pulleys 55 to provide spans which, as shown in FIG. 1, are vertical. The pulleys 55 are driven by a motor 57, FIG. 2. As the belt is driven breaking pins 58 projecting from the belt 54 pass between adjacent sides of bags to break the frangible interconnections 30. Thus, as the bags depart the bag feed and preparation portion 35, they are separated from one another but remain connected to the lips 38, 39.

A load station 60 includes a pair of parallel belt spreaders 61, 62. The belt spreaders are mirror images of one another. The belt spreaders respectively include channels which respectively guide the main transport belts 40,41, on either side of the load station 60. When the transport belts 40,41, are in the channels, as is clearly seen in FIG. 1, the bags 25 are stretched between the belts in a rectangular top opening configuration.

A schematic showing of a supply funnel 66 is included in FIGS. 1 and 2. As suggested by those figures, products to be packaged are deposited through the rectangular bag openings each time a bag is registered with the supply funnel at the load station.

A space adjusting mechanism is provided. This mechanism includes a spaced pair of adjustment screws 68, 69, FIG. 2. The adjustment screw 68, 69 have oppositely threaded sections which threadably engage the belt spreaders 61, 62. Rotation of a crank 72 causes rotation of the adjustment screw 69. The screw 69 is connected to the screw 70 via belts or chains 73, which function to transmit rotation forces so that when the crank 72 is operated the screws 68, 69 are moved equally to drive the spreaders equally into an adjusted spacial, but still parallel, relationship.

As loaded bags exit the load station, it is desirable to return upper portions of the bag faces and backs into juxtaposition. To facilitate this return the bag tops are stretched. This stretching of the now loaded bags as they exit the load station is accomplished with jets of air from nozzles 75, 76 which respectively direct air streams against the lead and trailing edges of the bag being stretched. This stretching of the bags assists in moving them from their rectangular orientations into face to back juxtaposed relationships as the transport belts are returned to juxtaposition.

Web Manufacture

Figure 4:
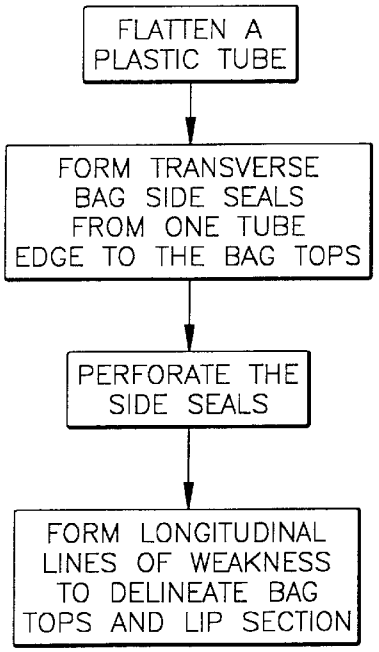

The improved web manufacturing process is set out in the flow chart of FIG. 4. Equipment used in the manufacture of chains of bags is well known to mechanics skilled in the art. Accordingly, the equipment itself is not shown.

In the manufacture, one starts with a flattened, heat sealable, plastic tube. Side seals 34 are formed. As is best seen in FIG. 3, the side seals 34 extend from the bag bottoms 33 to the longitudinal perforations 27,28 and fully to the sides of the bag. Indeed, to assure that the side seals extend fully to the bag sides, each seal 34 is of sufficient width to provide adjacent seals of adjacent bags.

After the side seals are formed the seals are perforated to provide the frangible connections 30 between adjacent bags. The longitudinal lines of weakness 27,28 are formed to delineate tops of the bag faces and backs 31,32 and the lip section 23. The longitudinal lines of weakness are immediately adjacent (or across small portions adjacent) the tops of the side seals.

While the sequence in forming the longitudinal lines of weakness and the lines of weakness providing the frangible bag connections is not important, it is important to form the side seals before the tube is perforated. If the perforations are formed first, the sealing operation may fuse the sides back together and unless done with extreme care the longitudinal lines of weakness are apt to be fused together or alternately the seal may end up spaced from those lines. Again, it is important that the seals extend to both of the S longitudinal lines of weakness to assure rectangular bag openings.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A process of forming a chain of interconnected bags connected in side by side relation comprising:

a) forming a tube with a selected one of a fold and a seal delineating bottoms of the bags;

b) forming a pair of elongated lines of weakness spaced from and paralleling the bag bottoms to delineate tops of bag faces and backs and a top section adapted to be split into a pair of bag supporting lips for transport of the bag through a packaging machine c) forming spaced bag side delineating seals each transverse to the bag bottoms and each including a portion extending to the longitudinal lines of weakness thereby to assure controlled separation of such lines of weakness to provide rectangular bag openings as a chain is transported through such packaging machine; and, d) forming side lines of weakness in each of the side seals and generally bisecting the seals to delineate readily disconnectable sides of adjacent bags.

2. The process of claim 1, wherein the elongated lines of weakness are perforations in the bag faces and backs.

3. The process of claim 1, wherein the side lines of weakness extend from the bag bottoms to the elongated lines of weakness.

4. The process of claim 1, wherein the side seals extend from the bag bottoms to the elongated lines of weakness.

5. In a process of forming a web of side connected bags having elongated lines of weakness between a web lip section which will form bag supporting lips during a packaging operation and faces and backs of bags being formed, the improved steps comprising:

a) fusing sections of the faces and backs together at spaced intervals such that the fused sections extend transversely from the elongated lines of weakness on a side of the elongated lines of weakness opposite said web lip section toward bag bottoms; and, b) forming bag side lines of weakness in the fused sections, the side lines of weakness generally bisecting the fused sections and extending from the elongated lines of weakness to the bag bottoms whereby to assure that the faces and backs of each bag are fused together in regions each delineated on any side by the elongated lines of weakness and on another side by the side lines of weakness, and to assure controlled separation of such lines of weakness to provide rectangular bag openings as the connected bags are transported through the packaging operation.

6. The process of claim 5, wherein the lines of weakness are perforations.

7. The process of claim 6, wherein the fused sections are formed by heat sealing.

8. The process of claim 5, wherein the fused sections are formed by heat sealing.

9. A process of forming a web of side connected bags to assume rectangular top openings when bags are opened to receive products during a packaging operation, the process comprising:

a) flattening a heat sealable plastic tube to provide front and back sections;

b) forming bag side delineating seals between the front and back sections, the side seals being disposed transversely of the tube;

c) perforating the front and back sections longitudinally to delineate tops of the bags and a lip section to one side of the longitudinal perforations and a bag section to the other side of the longitudinal perforations, the longitudinal perforations intercepting the seals;

d) perforating the seals to delineate sides of bags being formed, the seal perforations extending from bag bottoms to the longitudinal perforations whereby to enable side separation of adjacent bags during packaging operations; and, e) the seal perforations being located to generally bisect the seals transversely of the web whereby each bag has spaced sealed portions extending to side edges of the bag and to the bag top delineated by the longitudinal perforations.

10. The process of claim 9 wherein the side seals extend from the bag bottoms to the longitudinal separations.

* * * * *